US006477960B2

(12) United States Patent
Theurer et al.

(10) Patent No.: US 6,477,960 B2
(45) Date of Patent: Nov. 12, 2002

(54) MACHINE FOR REMOVING AN OLD TRACK AND LAYING A NEW TRACK

(75) Inventors: Josef Theurer, Vienna (AT); Manfred Brunninger, Altenberg (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 09/898,719

(22) Filed: Jul. 2, 2001

(65) Prior Publication Data

US 2002/0005140 A1 Jan. 17, 2002

(30) Foreign Application Priority Data

Jul. 13, 2000 (AT) ..... GM 514/2000

(51) Int. Cl.[7] ..... E01B 29/00
(52) U.S. Cl. ..... 104/9; 104/2
(58) Field of Search ..... 104/2, 7.1, 7.2, 104/7.3, 9

(56) References Cited

U.S. PATENT DOCUMENTS 4,160,418 A * 7/1979 Theurer ..... 104/2
4,236,452 A * 12/1980 Theurer ..... 104/2
4,253,398 A * 3/1981 Theurer ..... 104/2
4,854,243 A 8/1989 Theurer
4,867,068 A * 9/1989 Valditerra ..... 104/2
5,357,867 A * 10/1994 Theurer ..... 104/2
5,778,794 A * 7/1998 Theurer ..... 104/2

* cited by examiner

*Primary Examiner*—Mark T. Le
(74) *Attorney, Agent, or Firm*—Henry M. Feiereisen

(57) ABSTRACT

A machine for removing an old track and laying a new track includes a machine frame extending in a longitudinal direction and supported by undercarriages for mobility in an operating direction. A tie laying device for laying new ties is mounted on the machine frame between the undercarriages. A tie conveyor unit extending in the longitudinal direction includes a first conveying section, having a tie receiving end positioned ahead of the tie laying device in the operating direction and a transfer end positioned behind the tie laying device, and a second conveying section, positioned underneath the first conveying section, for receiving ties from the transfer end. The second conveying section has a delivery end positioned immediately behind the tie laying device in the operating direction.

7 Claims, 3 Drawing Sheets

MACHINE FOR REMOVING AN OLD TRACK AND LAYING A NEW TRACK

CROSS-REFERENCES TO RELATED APPLICATIONS

This application claims the priority of Austrian Patent Application Serial No. GM 514/2000, filed Jul. 13, 2000, the subject matter of which is incorporated herein by reference.

BACKGROUND OF THE INVENTION

The present invention relates, in general, to a machine for removing an old track and laying a new track composed of rails fastened to ties supported on ballast.

U.S. Pat. No. 4,854,243 discloses a track renewal machine for removing an old track and laying a new track, which includes a machine frame extending in a longitudinal direction and supported on the track by undercarriages for mobility in an operating direction. Mounted on the machine frame between the undercarriages is a tie lifting device for raising old ties and a tie laying device for laying new ties. A tie conveyor unit extends in the longitudinal direction. A clearing device in the shape of an endless clearing chain is provided between the tie lifting device and the tie laying device and serves to take up ballast from the track. The tie conveyor unit for transporting ties is positioned in such a way that it extends through said clearing chain. For reasons of space availability, the ties placed on the tie conveyor unit must be positioned so as to extend in the longitudinal direction in order to enable them to be moved through the chain. The end of the tie conveyor unit is located immediately in front of the tie laying device.

It would be desirable and advantageous to provide an improved track renewal machine which is so configured as to obviate prior art shortcomings and to allow transport of ties in the region between the tie lifting and the tie laying device in such a way as to leave sufficient space for placement of additional working units.

SUMMARY OF THE INVENTION

According to one aspect of the present invention, a machine for removing an old track and laying a new track composed of rails fastened to ties supported on ballast, includes a machine frame extending in a longitudinal direction and supported on the track by undercarriages for mobility in an operating direction; a tie lifting device, mounted on the machine frame between the undercarriages, for raising old ties; a tie laying device, mounted on the machine frame between the undercarriages, for laying new ties; and a tie conveyor unit extending in the longitudinal direction and including a first conveying section, having a tie receiving end positioned ahead of the tie laying device in the operating direction and a transfer end positioned behind the tie laying device, and a second conveying section, positioned underneath the first conveying section, for receiving ties from the transfer end, wherein the second conveying section has a delivery end positioned immediately behind the tie laying device in the operating direction.

In accordance with the present invention, the ties can now be positioned parallel to the longitudinal direction during the entire transport path through the region between the tie lifting device and the tie laying device, up to the point where the ties must be turned into the final transverse position extending perpendicularly to the longitudinal direction. As a result, a maximum of space for installing further working units remains available between the tie lifting and tie laying devices. An increase in distance between the tie lifting and tie laying devices is therefore not necessary. Advantageously, the track-less construction gap located between the tie lifting device and the tie laying device can thus be utilized for taking up the soiled or contaminated ballast by means of -a clearing chain, and for discharging as well as grading and compacting cleaned ballast. The conveyor belts required for this purpose can also be arranged in this space without problems due to the particular design of the tie conveyor unit.

According to another aspect of the present invention, a machine for removing an old track and laying a new track composed of rails fastened to ties supported on ballast, includes a machine frame extending in a longitudinal direction and supported on the track by undercarriages for mobility in an operating direction; a tie lifting device, mounted on the machine frame between the undercarriages, for raising old ties; a tie laying device, mounted on the machine frame between the undercarriages, for laying new ties; a tie rotating device, mounted on the machine frame, for swivelling ties into a position extending in the longitudinal direction; and a tie conveyor unit extending in the longitudinal direction and including a first conveying section, having a tie receiving end positioned ahead of the tie lifting device in the operating direction and a transfer end positioned ahead of the tie lifting device, and a second conveying section positioned underneath the first conveying section and having a receiving end positioned immediately ahead of the tie lifting device in the operating direction.

BRIEF DESCRIPTION OF THE DRAWING

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
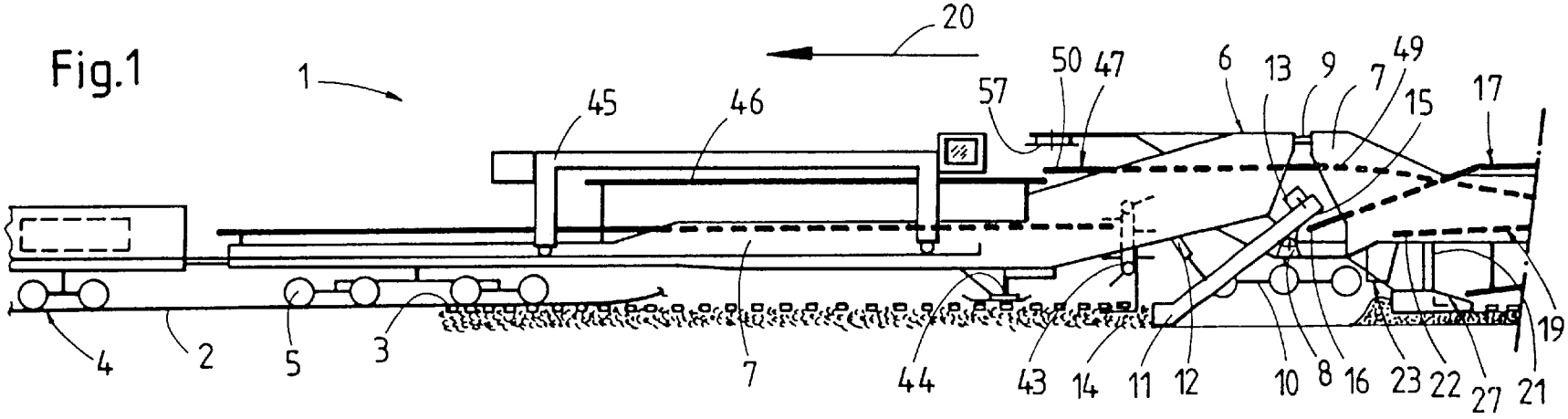
FIG. 1 is a schematic side elevational view of a front portion of a track renewal machine according to the present invention.

This is one of three applications filed on the same day. All three applications deal with related inventions. They are commonly owned and have the same inventive entity. All three applications are unique, but incorporate the other by reference. Accordingly, the other U.S. patent applications, Appl. Ser. No. 09/898,739, filed Jul. 2, 2001, and Appl. Ser. No. 09/898,738, filed Jul. 2, 2001, now U.S. Pat. No. 6,422,150, both entitled "Machine for Renewing a track ", are hereby expressly incorporated by references.

Throughout all the Figures, same or corresponding elements are generally indicated by same reference numerals.

Figure 2:
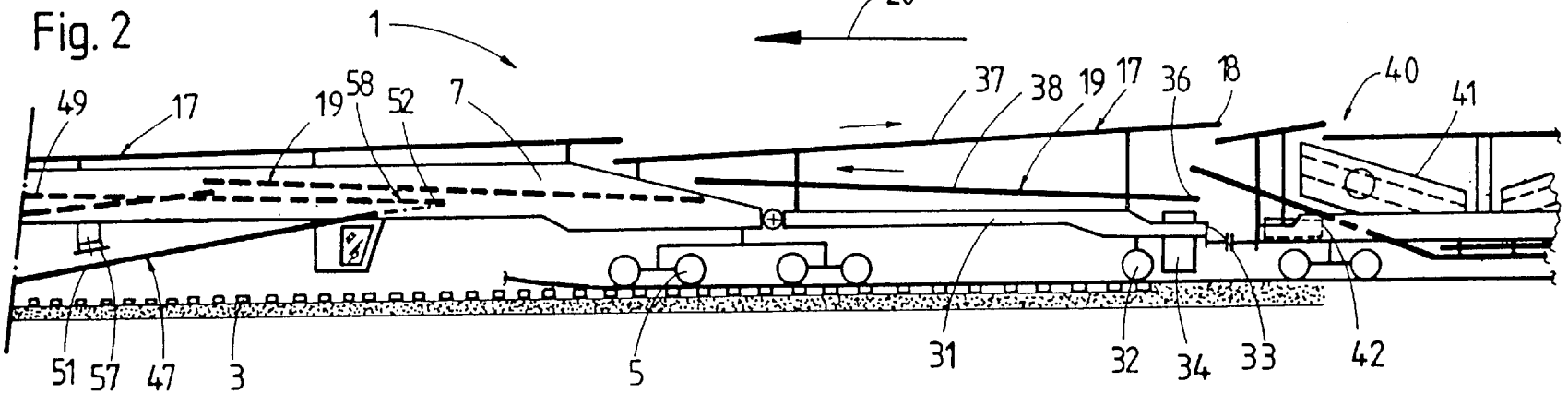
FIG. 2 is a schematic side elevational view of a rear portion of the track renew machine.

Turning now to the drawing, and in particular to FIGS. 1 and 2, there is shown a track renewal machine, generally designated by reference numeral 1 for removing an old track 4 and for laying a new track 4. The track 4 is composed of two rails 2 fastened to ties 3 which rest on ballast 14. The track renewal machine 1 includes an elongated machine frame 6 which extends longitudinally in a direction along the track 4 and has opposite ends supported on the track 4 by two undercarriages 5 for mobility in an operating direction indicated by arrow 20. The machine frame 6 has front and rear frame parts 7 arranged behind one another in the longitudinal direction and articulatedly connected to one another by a frame joint 8. A drive 9 interconnects the frame parts 7 in the region above the frame joint 8 and serves to spread the frame parts 7 apart in a horizontal direction and to thereby cause the frame parts to be raised in a vertical direction at their ends connected by the frame joint 8. An additional undercarriage 10 located underneath the frame joint 8 is thereby also raised off the track 4. The drive 9 is further effective to steer the articulated machine frame 6, when traveling in track curves with the undercarriage 10 in the raised position.

In the region of the frame joint 8, a ballast clearing device 11 is mounted on the machine frame 6 for vertical adjustment by a drive 12. The ballast clearing device 11 is equipped with an endless chain, which is rotated by a drive 13 and picks up ballast 14 of the track 4 for transport to a discharge end 15. A first conveyor 17 extends in the longitudinal direction along the machine frame 6 and has a discharge end 18 and a receiving end 16 which is associated with the discharge end 15 of the ballast clearing device 11. Provided underneath the first conveyor 17 and also extending in the longitudinal direction is a second conveyor 19, having a discharge end 22 which is arranged immediately ahead—with regard to the operating direction shown by arrow 20—of a tie laying device 21 mounted on the machine frame 6. A ballast discharge device 23 is located underneath the discharge end 22 of the second conveyor 19 and includes a chute 24 with outlet openings 25, as shown in particular in FIG. 3.

Figure 3:
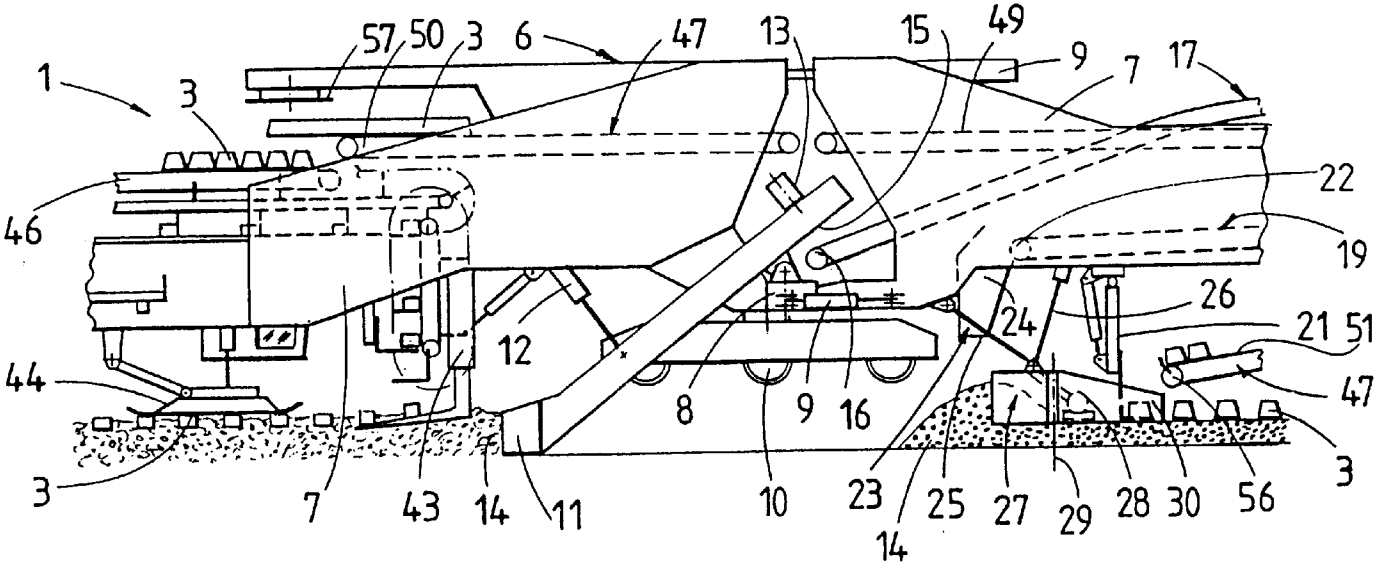
FIG. 3 is a side elevational cutaway view, on an enlarged scale, of a middle portion of the track renewal machine.

As can be seen more clearly in FIG. 3, a ballast planing device 27 is positioned between the tie laying device 21 and the immediately preceding ballast discharge device 23, and is connected to a vibratable ballast consolidating unit 28 and designed for vertical adjustment by drives 26. Additionally, the ballast planing device 27 includes two plow shields 30 which are positioned at either side of the tie laying device 21, respectively, and spaced from one another transversely to the longitudinal direction. Each plow shield 30 is pivotable about a vertical axis 29.

Figure 4:
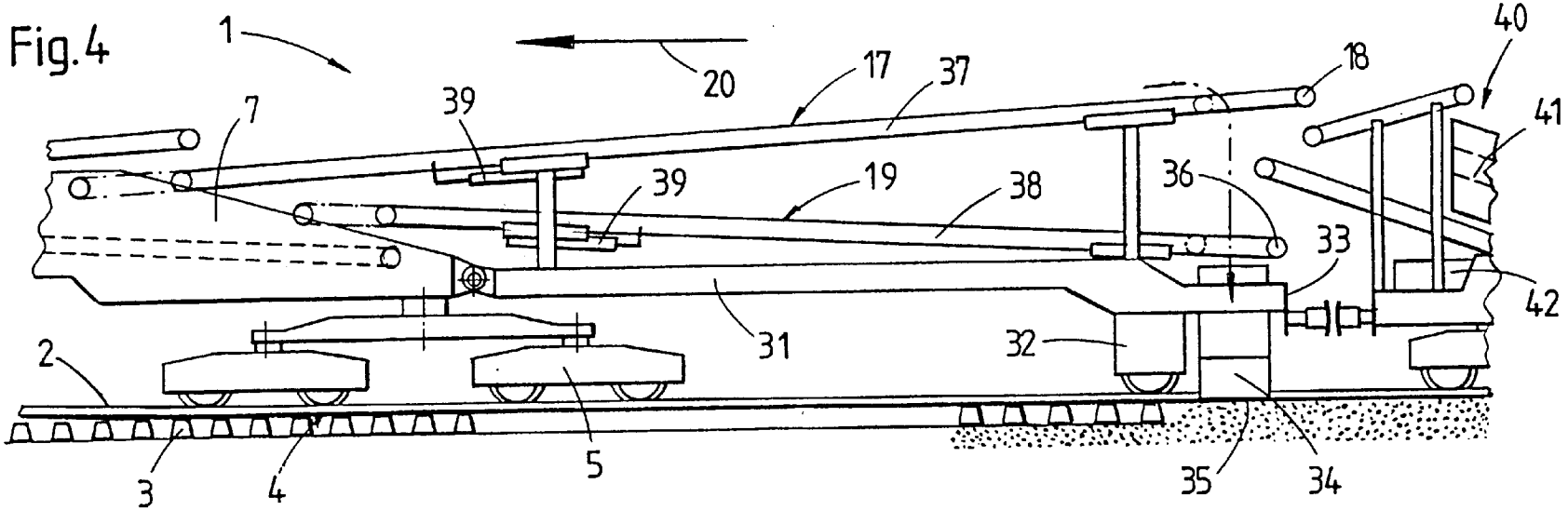
FIG. 4 is a side elevational cutaway view, on an enlarged scale, of a leading portion of the rear portion of the track renewal machine.

As shown in FIG. 2 and, more particularly, in FIG. 4, the rear frame part 7, following in the operating direction, is provided with an extension in the shape of a frame 31 supported in a trailer-like manner on an undercarriage 32. Thus, a working space for screwing operations on the track 4 is created under the frame 31. A ballast chute 34, having outlet openings 35 distanced from one another transversely to the longitudinal direction, is arranged at a machine end 33 which is located immediately behind the undercarriage 32 (FIG. 4). A receiving end 36 of the second conveyor 19 is positioned above the ballast chute 34.

As illustrated in FIG. 4. the first conveyor 17 has a rear conveyor belt 37, and the second conveyor 19 has a further rear conveyor belt 38. Both rear conveyor belts 37 and 38 are supported on the frame 31 and are mounted for displacement in the longitudinal direction by means of a respective drive 39. A screening car 40 is coupled to the rear machine end 33 and includes a vibratable screening installation 41 for cleaning ballast and a motor unit 42 for supplying energy.

A tie lifting device 43 is arranged on the machine frame 6 immediately ahead of the ballast clearing device 11 in the operating direction of the machine 1. A tracing device 44 for tracing the vertical position of the old ties 3 is arranged on the front frame part 7 of the machine frame 6 immediately ahead of the tie lifting device 43. A gantry crane 45 is mounted for mobility on the front frame part 7 and serves to remove the old ties 3 and to deliver new ties 3 to a conveyor unit 46 attached to the front frame part 7. The new ties 3 are then delivered to the tie laying device 21 by means of a tie conveyor unit 47 which extends in the longitudinal direction along the machine frame 6.

Figure 5:
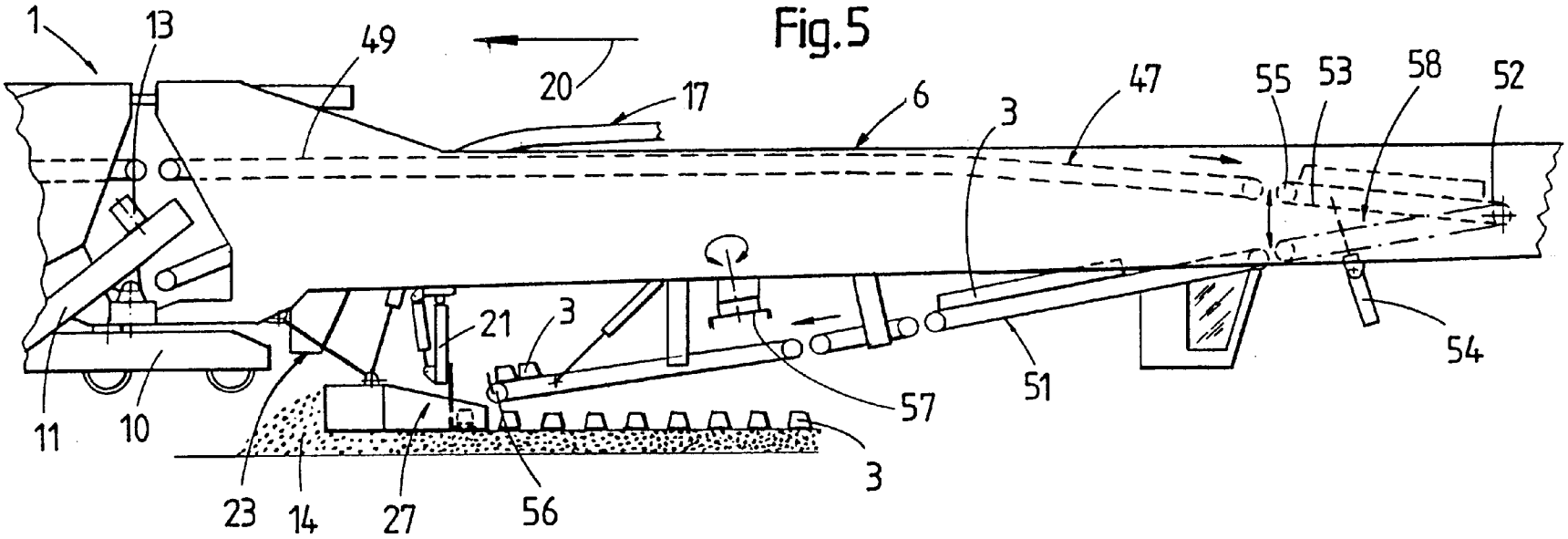
FIG. 5 is a side elevational cutaway view, on an enlarged scale, of a trailing portion of the rear portion of the machine.

As is shown in FIGS. 3 and 5, the tie conveyor unit 47 for transporting new ties 3 includes a first conveying section 49 and a second conveying section 51 positioned underneath the conveying section 49. The conveying section 49 has a tie receiving end 50, positioned ahead of the tie laying device 21 in the operating direction of the machine 1, and a transfer end 52 located behind the tie laying device 21 and having the shape of a transfer conveyor belt 53. The conveyor belt 53 is designed to be vertically adjustable by means of a drive 54 between the two conveying sections 49 and 51 (see double arrow in FIG. 5), thus forming a tie transfer site 58. A rotation drive 55 is provided for actuation of the transfer conveyor belt 53 for transporting ties in the operating direction of the machine 1 or in the opposite direction, as desired. A delivery end 56 for releasing the new ties 3 is arranged immediately behind the tie laying device 21 (see FIG. 3). A respective tie rotating device 57 is operatively connected with the first and the second conveying section 49,51 in their forwardly located end regions for turning the ties 3 into the longitudinal or transverse position, as required.

During working operations, as the machine 1 moves forward in the operating direction, new ties 3 are continuously delivered by the tie conveyor unit 47 and subsequently laid upon the ballast bed with the aid of the tie laying device 21. The ties, having been swivelled into the longitudinal position by the first one of the tie rotating devices 57 (see FIGS. 1 and 3), are moved to the second conveying section 51 at the tie transfer site 58 by lowering the transfer conveyor belt 53 into the plane of the second conveying section 51 with actuation of the drive 54. Actuation of the rotation drive 55 of the transfer conveyor belt 53 in the opposite or reverse direction causes the ties 3 to be transported onward via the second conveying section 51 to the second one of the tie rotating devices 57. The latter serves to turn the ties 3 into a position extending perpendicularly to the longitudinal direction, after which the ties are transported to the delivery end 56. The frontmost or leading one of the ties 3 is then gripped by the tie laying device 21 and placed upon the planed and compacted ballast bed.

Figure 6:
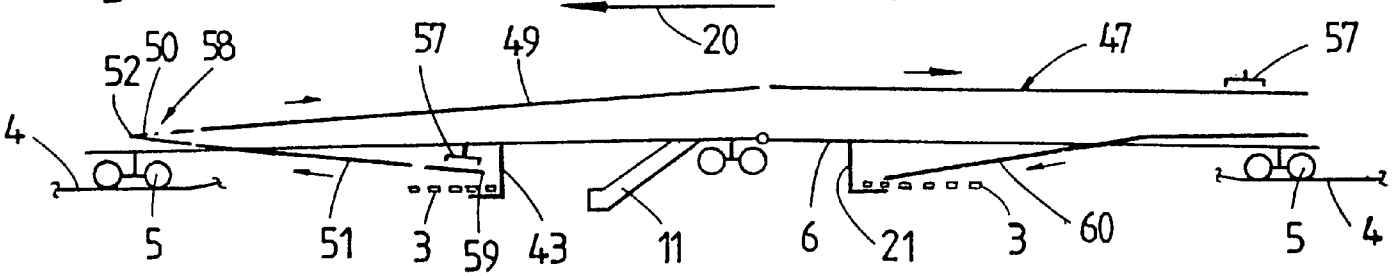
FIG. 6 is a schematic representation of another embodiment of a track renewal machine according to the present invention.

FIG. 6 shows a schematic illustration of another embodiment of a track renewal machine according to the present invention. Parts corresponding with those in FIGS. 1 to 5 are denoted by identical reference numerals and not explained again. In this embodiment, provision is made for a tie conveyor unit 47, which instead of transporting the new ties 3 is configured for removing old ties 3 from the tie lifting device 43 and transporting them to a receiving end 59 of the second conveying section 51. The new ties 3 are transported by means of a further tie conveyor unit 60 to the tie laying device 21. The tie transfer site 58 is realized in a same way as described with reference to the embodiment of FIGS. 1 to 5, by transferring an old tie 3 from the second conveying section 51 to the first conveying section 49 and then transporting it, in a direction opposite to the operating direction, to the tie rotating device 57.

While the invention has been illustrated and described as embodied in a machine for removing an old track and laying a new track, it is not intended to be limited to the details shown since various modifications and structural changes may be made without departing in any way from the spirit of the present invention.

What is claimed as new and desired to be protected by Letters Patent is set forth in the appended claims:

1. A machine for removing an old track and laying a new track composed of rails fastened to ties supported on ballast, comprising:

(a) a machine frame extending in a longitudinal direction and supported on the track by undercarriages for mobility in an operating direction;

(b) a tie lifting device, mounted on the machine frame between the undercarriages, for raising old ties;

(c) a tie laying device, mounted on the machine frame between the undercarriages, for laying new ties;

(d) a tie conveyor unit extending in the longitudinal direction and including a first conveying section, having a tie receiving end positioned ahead of the tie laying device in the operating direction and a transfer end positioned behind the tie laying device, and a second conveying section, positioned underneath the first conveying section, for receiving ties from the transfer end, wherein the second conveying section has a delivery end positioned immediately behind the tie laying device in the operating direction;

(e) a transfer conveyor belt positioned behind the tie laying device in the operating direction and operatively connected with the first and second conveying sections for forming a tie transfer site; and (f) a drive for vertical adjustment of the transfer conveyor belt between the first conveying section and the second conveying section, and a rotation drive for actuation of the transfer conveyor belt for tie transport in the operating direction or in a direction opposite to the operating direction, as desired.

2. The machine of claim 1, wherein the second conveying section includes a tie rotating device for swivelling a tie from a position extending in the longitudinal direction into a transverse position extending perpendicularly to the longitudinal direction.

3. A track renewal machine, comprising:

an elongate machine frame supported on a track by undercarriages for travel in an operating direction;

a tie lifting device for lifting old ties from a renewal section;

a tie laying device trailing the tie lifting device on the machine frame for placing new ties on the renewal section; and a conveyor assembly extending in the operating direction and intended for receiving new ties and transferring them to the tie laying device, said conveyor assembly being so configured as to transport the new ties between a tie receiving end, which is positioned ahead of the tie laying device, and a delivery end, which is positioned in immediate proximity behind the tie laying device, without restriction to spatial dimensions of the renewal section, wherein the conveyor assembly includes a first conveyor, a transfer conveyor and a second conveyor, with the transfer conveyor configured for shuttling between the first and second conveyor so as to receive ties from the first conveyor for transfer to the second conveyor, and wherein the conveyor assembly includes a first rotation drive interacting with the transfer conveyor for moving the transfer conveyor for tie transport in the operating direction or in a direction opposite to the operating direction.

4. The machine of claim 3, wherein the second conveyor is located underneath the first conveyor.

5. The machine of claim 3, wherein the second conveyor extends at an angle to the first conveyor in the direction of the tie laying device.

6. The machine of claim 4, wherein the transfer conveyor is configured for two-way operation so as to move in one direction when aligned with the first conveyor for receiving ties and to move in opposite direction when aligned with the second conveyor for transfer of the ties to the second conveyor.

7. The machine of claim 3 wherein the conveyor assembly includes a second rotation drive interacting with the second conveyor for turning the ties from a longitudinal alignment to a transverse alignment.

* * * * *